US005142709A

United States Patent [19]

McGuire

[11] Patent Number: 5,142,709

[45] Date of Patent: Sep. 1, 1992

[54] HYDRAULIC COMMODE ASSEMBLY

[75] Inventor: Micky L. McGuire, Leesburg, Ga.

[73] Assignee: Hydra-Commode Lift Services, Inc., Gaithersburg, Md.

[21] Appl. No.: 571,984

[22] Filed: Aug. 24, 1990

[51] Int. Cl.[5] ..... A47K 13/10

[52] U.S. Cl. ..... 4/667

[58] Field of Search ..... 4/480, 251, 254; 297/337-339, DIG. 10

[56] References Cited

U.S. PATENT DOCUMENTS

| | | | |
|---|---|---|---|
| 3,458,872 | 8/1969 | Hellstrom et al. | 297/DIG. 10 X |
| 3,473,174 | 10/1969 | Cool | 4/251 |
| 3,848,845 | 11/1974 | Bogart | 297/DIG. 10 X |
| 4,185,335 | 1/1980 | Alvis | 4/251 |
| 4,587,678 | 5/1986 | Love et al. | 297/DIG. 10 X |
| 4,884,841 | 12/1989 | Holley | 4/254 X |
| 4,993,085 | 2/1991 | Gibbons | 4/251 |

*Primary Examiner*—Charles E. Phillips

[57] ABSTRACT

A hydraulically operated commode seat assembly provides lowering a handicapped person from a standing position to a seated position through a natural range of movement. The assembly includes a hydraulic cylinder that operates on household water pressure. A control device for the hydraulic cylinder which controls the position of the seat. A linkage mechanism connected to a support arrangement for one seat includes a dog leg linkage connected to the hydraulic cylinder. The device is free standing and is designed to have a lifting capacity of 885 lbs. The primary use of the device is in helping physically limited persons to safely and comfortably lower themselves to a sitting position or raise themselves to a standing position with little or no assistance, and this is accomplished by either raising or lowering the pressure in the hydraulic cylinder using the control device. The linkage mechanism including the dog leg linkage prevents scissoring effects and thus the device is safer to use than prior art devices employing scissoring linkage mechanisms.

7 Claims, 2 Drawing Sheets

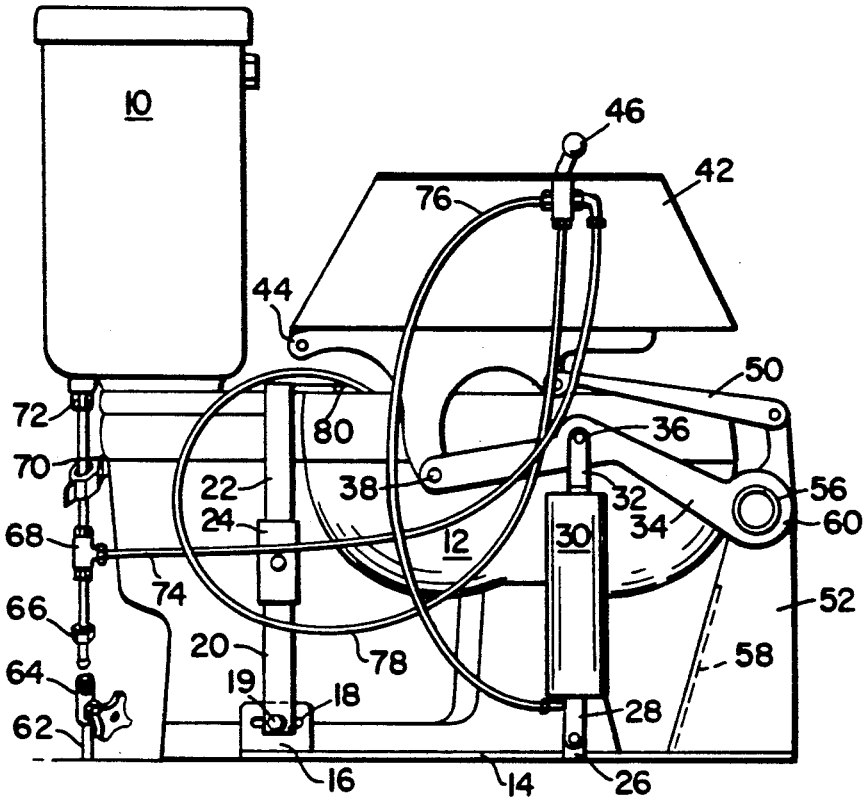
Fig. 3
Fig. 4
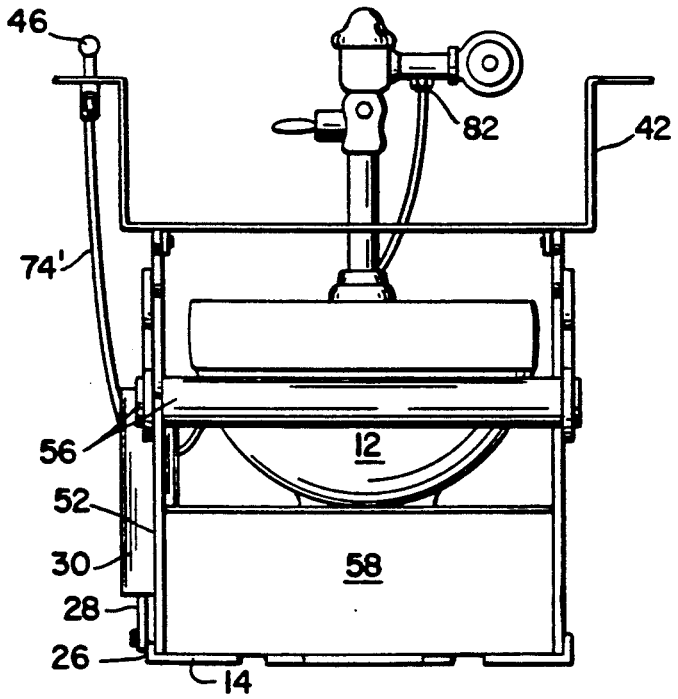

HYDRAULIC COMMODE ASSEMBLY

FIELD OF THE INVENTION

This invention relates generally to commode or toilet seat constructions and more specifically, to an improved commode seat construction of the type which provide for automatically lowering a person to a sitting position on the commode and for thereafter raising that person to a standing position using a hydraulically operated lifting mechanism employing household water pressure.

BACKGROUND OF THE INVENTION

There has been a long existing need to provide handicapped persons as well as the weak and infirm, such as post-operative patients in hospital care, with toilet facilities (hereinafter, a commode or toilet) which is suitable for their use without assistance or with minimal assistance from hospital or home nursing personnel. Apart from obvious advantages of such a commode such as reducing the demands on the time of often overworked nursing personnel, it has been determined that, psychologically, many elderly and failing persons tend to give up hope once they can no longer use a toilet without assistance from others. Therefore, a commode that can be readily used by handicapped or infirm individuals would be of real value. Such a commode seat must provide a safe lifting mechanism to raise and lower a person so that a commode may be used without the assistance of love ones, medical professionals or others. Another major requirement of such a commode is the ability to be able to clean the commode without interference from the lifting mechanism.

Several such commodes or toilets have been proposed in the prior art and, in particular, in U.S. Pat. Nos. 4,587,678 (Love et al); 4,185,335 (Alvis); 3,905,051 (Gozdziewski); and 3,473,174 (Cool). While the toilet devices disclosed in these patents generally enable use thereof without outside assistance, and, are designed to aid or facilitate seating of the ill, the elderly, and the handicapped on a toilet or commode, these devices present safety problems as well as problems associated with the cleaning of the commode.

Briefly considering these patents, the Love patent discloses a boosting device comprising a stationary frame having handrails and a movable seat assembly. The Love device uses a single electric motor which drives a screw mechanism that raises and lowers the unit. It will be appreciated that the provision of an electric motor on the floor of a bathroom presents a potential electrocution hazard.

The Alvis patent discloses a toilet seat for the infirm that is mounted to a conventional toilet bowl by bolts. The device is hydraulically powered by the water supply for the toilet. The seat portion of the device is elevated or lowered in a preselected arc by a hand-activated valve. However, while the device includes an adjustable seat mechanism the device suffers a number disadvantages. For example, the lift mechanism includes uncovered scissoring link members and such uncovered scissoring link members provide a potential hazard to an unwary, careless or infirm user in that the body parts or the clothing of such a user can be caught therein. To compound this hazard, the device is hydraulically powered down so that, in effect, it provides a powered scissor effect. Further, the device of this patent offers no support in and of itself and is, in general, only as stable as the commode that it is attached to.

The Gozdziewski patent discloses a toilet seat cover comprising hand grips for supporting an infirm person. The device is bolted to a standard commode. This device does not provide an automated boosting arrangement and also presents problems with respect to the cleaning of the commode.

The Cool patent discloses a hydraulic lift mechanism that enables an incapacitated person to shift from a standing position to a sitting position and vice versa. This is accomplished by a hydraulic lift system that can raise or lower the toilet seat to any desired level. This device uses a reversible motor and hydraulic pressure to accomplish raising of the seat. The device presents hazards and suffers drawbacks similar to those discussed above. For example, the device includes multiple scissoring linkages that present a safety hazard.. Also, the device is a hydraulically operated unit which is powered by an electric motor and pump, and, as noted, such an electric motor presents a potential threat of electrocution in a bathroom environment.

SUMMARY OF THE INVENTION

In accordance with the present invention there is provided a hydraulic toilet seat assembly which provides for movement of an infirm or handicapped person from a standing position to a seated position through a path of natural movement. The seat is hydraulically raised or lowered by an activating device which either raises or lowers the pressure in a hydraulic cylinder so as to, in turn, cause the seat to move from a raised position to a lowered position or vice versa. This movement is accomplished with no overlapping or scissoring of any linkages throughout the full range of movement, thus providing for a much safer device as compared with those discussed above. Easy access for cleaning is provided by pivotal mounts which allow the seat to be moved to a position that permits ready access to the commode below. Other advantages of the present invention, particularly in commercial applications, include improved safety and labor savings in addition to the obvious psychological advantages accruing to a user in both commercial or home use applications.

In accordance with a preferred embodiment, a hydraulic commode assembly is provided which comprises a base support adapted to fit around an existing commode; a seat for a user of the commode assembly; and hydraulic lifting means, secured between the base support and the commode seat and including first and second pairs of pivotable link members, for providing raising and lowering of the seat relative to the commode without any crossing over, and thus scissoring, of the link members during the raising and lowering of the seat, thereby eliminating an important disadvantage of some of the prior art devices discussed above.

The lifting means preferably further includes at least one hydraulic cylinder-piston rod assembly, connected to the base support and disposed, in use, on one side of the commode, for providing extension and retraction of the piston rod; first and second upright supports disposed, in use, on opposite sides of the commode and secured to the base support, these said first and second upright supports each including first and second vertically spaced pivot connections; and a support assembly for the seat including first and second laterally spaced, downwardly depending support members secured to opposite sides of the seat and each defining first and second longitudinally spaced pivot points. Further, the first pair of pivotable link members include a first pivotable link extending between, and pivotably connected to, the first pivot connection of the first upright support and the first pivot point of the first support member, and further pivotably connected, intermediate the ends thereof, to the piston rod of the hydraulic cylinder-piston assembly, and a second pivotable link extending between, and pivotably connected to, the first pivot connection of the second upright support and to the first pivot point of the second support member. In addition, the second set of pivotable link members comprises third and fourth pivotable links disposed on opposite sides of the commode and extending between, and being pivotably connected to, the second pivot points of the first and second support members, respectively, and the second pivot connections of the first and second upright supports, respectively.

In all embodiments, the first set of pivotable link members advantageously comprises a pair of dog leg links respectively disposed, in use, on opposite sides of the commode.

According to a further important aspect of the invention, a means is provided for pivotably mounting the seat on the support assembly so as to enable the seat to be placed in a cleaning position.

In accordance with a further important feature, a channel-shaped brace is attached to the base support on opposite sides of the commode and clamped, in use, to the top of the commode behind the bowl. The channel-shaped brace preferably comprises a pair of lower brace members, an upper channel-shaped brace member, and a brace clamp for adjustably connecting said upper brace member to the lower brace members so as to accommodate commodes of various heights. Additionally, the assembly further comprises mounting means for adjustably attaching the channel-shaped brace to the base support so as to permit longitudinal movement of the brace relative to the base support.

Advantageously, a toe plate is attached to the front of the base unit in front of the bowl of the commode.

In a preferred embodiment of the pressure system for the hydraulic cylinder, a water line, connected to a water connection for supplying water to the commode, is provided for supplying pressure to the cylinder. Preferably, the hydraulic lifting means further comprises control means for increasing and lowering said water pressure in the hydraulic cylinder, a valve line, which is attached, in use, to one end to a household water supply and at the other end to the control means, for providing water to pressurize the hydraulic cylinder, a cylinder hose which is attached at one end thereof to the control means and is connected at the other end thereof to said hydraulic cylinder, and a discharge hose which is attached at one end thereof to the control means and is connected at the other end thereof, in use, to the bowl of the commode for relieving the pressure in the hydraulic cylinder.

Other features and advantages of the invention will be set forth in, or apparent from, the following detailed description of preferred embodiments of the invention.

BRIEF DESCRIPTION OF THE DRAWINGS

FIG. 3 is a side elevational view of the hydraulically operated commode assembly, similar to that of FIG. 1 but including the water connections and showing the seat in the lowered position; and FIG. 4 is a front elevational view of an alternative embodiment of a hydraulically operated commode assembly constructed in accordance with the invention.

DESCRIPTION OF THE PREFERRED EMBODIMENTS

Figure 1:
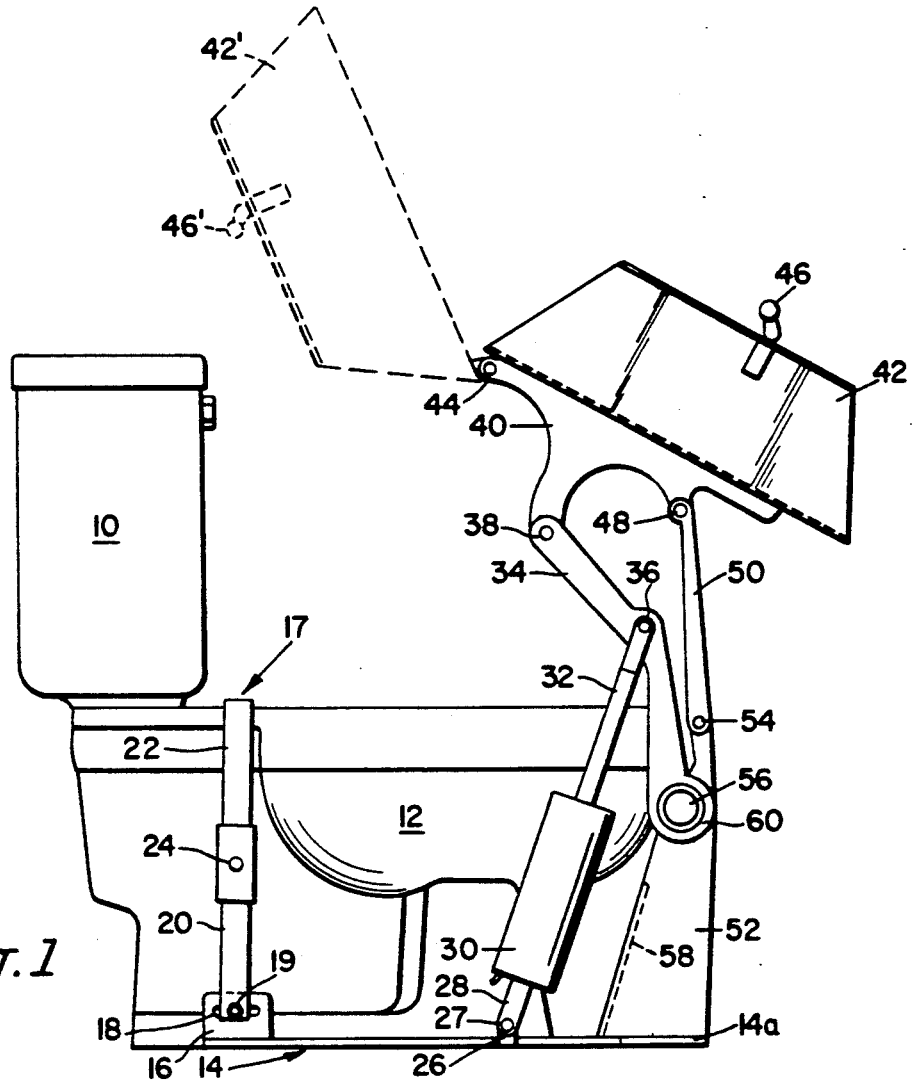
FIG. 1 is a side elevational view of a hydraulically operated commode assembly constructed in accordance with a preferred embodiment of the invention, showing the seat in a raised position.

Referring to FIG. 1, an hydraulic commode assembly constructed in accordance with a preferred embodiment of the invention is shown. The lifting and lowering apparatus of the invention is employed in conjunction with a typical conventional toilet which includes a toilet tank 10 and toilet bowl 12 normally constructed of porcelain or the like. The apparatus includes a base assembly 14, comprising a pair of plates **14*a* and 14*b* that rest on the floor and are located on opposite sides of toilet bowl 12**.

Near one end of base member 14 is attached a brace lug 16. A slot 18, located near the top of brace lug 16 and running from the rear to front of brace lug 16, provides adjustable mounting of a channel-shaped brace assembly 17 including a lower brace 20 and an upper brace 22. Slot 18 enables the brace assembly 17 to be adjusted to accommodate toilet bowls of different dimensions. Lower brace 20 is mounted securely to brace lug 16 by a fastener 19, such as pin and nut, that can slide in slot 18 and that, when tightened, firmly secures lower brace 20 to brace lug 16. Upper brace 22 is a channel-shaped brace member that mounts to and extends around the top of toilet bowl 12 and is secured to lower brace 20 and to a similar lower brace (not shown) on the opposite side. Considering lower brace 20, a brace clamp 24 connects lower brace 20 to upper brace 22 so as to provide a secure attachment of the brace assembly 17 to bowl 12. Braces 20 and 22 are, when installed, slidable with respect to one another and include aligned slots (not shown) therein that permit the height of the brace assembly 17 to be adjusted. A bolt 25 extends through clamp 24 and these aligned slots (not shown) to secure the brace assembly 17 in position. It will be appreciated from the foregoing that the brace assembly 17 is adjustable in height as well as longitudinally and when fixed in position prevents side to side and front to rear sliding movement about bowl 12.

Turning now to a consideration of the hydraulic lift assembly and associated linkage of the invention, located forwardly of brace lug 16 at approximately the midpoint of commode 12 is a cylinder lug 26 which is also attached to base assembly 14. A cylinder arm 28 is pivotally mounted to the cylinder lug 26 by a pin 27 or other suitable fastener. A hydraulic cylinder 30 is connected to the other end of cylinder arm 28 and a piston rod 32 of the hydraulic cylinder 30 is attached to the center of a dog leg link 34 by a pivot pin 36. A second pivot pin 38 located at the upper end of dog leg linkage 34 provides a mounting point for an upper seat support member 40.

Figure 2:
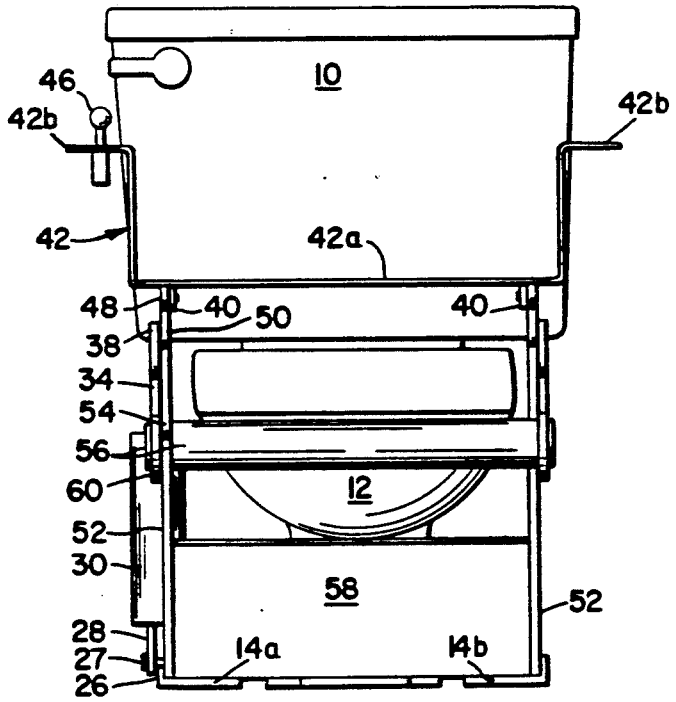
FIG. 2 is a front elevational view of the hydraulically operated commode assembly of FIG. 1, showing the seat in a lowered position.

A seat 42 is pivotally mounted by a pivot mount (e.g., pin) 44 to upper support member 40. It will be appreciated that a similar support member 40 (see FIG. 2) is provided on the opposite side of toilet bowl 12 and is similarly pivotably connected to seat 42. This pivoting arrangement, including pivot pins 44, allows seat 42 to be rotated in an up and backwards direction, as indicated in dashed lines in FIG. 1, so as to allow for the cleaning of toilet bowl 12. Further, seat support members 40 act as braces or supports for seat 42 in the horizontal position thereof so that seat 42 is supported above bowl 12 for use by a patient or the like. Seat 42 can be pivoted upwardly and backwardly until the top surface of seat 42 comes into contact with toilet tank 10. As shown in FIG. 2, seat 42 is generally channel-shaped in cross section and is of one piece construction including a base portion 42*a* and side walls or arms 42*b*. The base portion 42*a* includes a suitable opening (not shown) centrally therein.

Attached to seat 42 is activating or control device 46 for controlling actuation of hydraulic cylinder 30 to provide either raising or lowering of seat 42 relative to the toilet bowl 12 as described in more detail below.

Considering one side of the lifting linkage mechanism, a further pivot mount (pin) 48, located forward of pivot mount 38, provides a connection between upper support member 40 and a straight linkage member 50. Straight linkage member 50 is connected at the other end to an upright support plate 52 by a pivot mount 54 such as a pivot pin or the like. The dog leg linkage 34 is attached to another pivot mount 56, located below pivot mount 54 and supported by support plate 52 and bushing 60. Support plate 52 itself is connected to base assembly 14 by welding or in another suitable manner.

FIG. 2 illustrates a front view of the preferred embodiment of the device of FIG. 1 showing the seat 42 in the lowered positioned thereof. Because the hydraulic commode is essentially symmetrical about a vertical axis that passes through water tank 10 and bowl 12 and, as mentioned above, most of the control linkage mechanism is duplicated on each side of toilet bowl 12. More specifically in this regard, the only components that are not duplicated are the activating control device 46 and hydraulic cylinder and its components, i.e., cylinder arm 28, hydraulic cylinder 30, and piston 32. Further, the hydraulic lift assembly itself can be duplicated on both sides in order to provide additional lift when there is low water pressure or additional lifting capacity is desired, with no further manufacturing processes, and only a simple assembly involved.

As can best be seen in FIG. 2, a toe plate 58 is connected between the right and left hand linkage plates 52. The toe plate 58 is positioned so as to enable a fully functional person to stand close to bowl 12 and add side-to-side structural rigidity. A pivot tube 61 connects the left and right pivot mounts 56 so as to cause them to move in tandem when applying pressure to one side through a single hydraulic cylinder 30.

FIG. 3 is a side elevational view of the hydraulic commode assembly in a lowered position, i.e., in the position shown in FIG. 2, and illustrates the hose connections required in order for the hydraulic cylinder 30 to function properly. These hose connections comprise a cold water line 62, fabricated of PVC or copper, that first enters the bathroom via the floor or a wall. A shut off valve 64 is connected to a first section 62 of a cold water line. Shut off valve 64 provides the ability to turn off the flow of water to the water tank 10 and can be of a construction known in the art. A compression nut 66 is provided to produce a watertight seal between shut off valve 64 and a 'T' fitting 68. At the opposite end of 'T' fitting 68 is a second section 70 of the cold water line. Water line section 70 is secured to toilet tank 10 by a nut 72. A valve line 74 is attached to the central nipple of the 'T' fitting 68. This line 74 provides hydraulic pressure to the activating control device 46 mentioned above. A cylinder hose 76 provides a connection between activating device 46 and hydraulic cylinder 30. A discharge hose 78 is connected between activating device 46 and toilet bowl 12. The discharge hose 78 is held in place by a hose guide 80 mounted on the upper brace 22.

Considering the overall operation of the hydraulic commode assembly of the invention, a first mode of operation is established by setting the activating device 46 to a control position or setting wherein the seat 42 is moved to the raised position shown in FIG. 1 from the lowered position shown in FIGS. 2 and 3. In this position, activating device 46 causes water flowing through the cold water line 62 to be diverted through the 'T' fitting 68 and into valve line 74. The water flows from valve line 74 into cylinder line 76 in this setting of activating device 46. The resultant increase in pressure in hydraulic cylinder 30 causes piston 32 to be pushed outwardly. The outward movement causes the dog leg link 34 to move upwardly and to rotate about pivot axis 56. Thus, as stated, seat 42 is caused to move to the raised position shown in FIG. 1.

By setting the activating device 46 to a lowering position or setting, a second mode of operation is established. In this mode of operation, the weight of a person sitting in the seat 42 (or the weight of the seat itself) forces piston 32 back into hydraulic cylinder 30. This causes water to flow in the cylinder line 75 towards the activating device 46. The water then flows into drain hose 78 from which the water is eventually released into the toilet bowl 12. The reduction in water pressure causes seat 42 to gradually move to the lowered or rest position thereof.

The linkages of the lifting mechanism discussed above are designed to have a load bearing capacity that far exceeds an average adult weight and working together, as illustrated and discussed, are safe beyond the pressure applied by the hydraulic cylinder 30. These linkages are safe not only with respect to load bearing capacity but also regarding the physical design characteristics thereof. In this regard, the linkages while in a stationary position and while in motion are characterized by a complete absence of any overlapping outside the tangent points of the radius of the connecting points of the linkages with the result that no pinch points or scissoring exists throughout the full range of movement of the linkages.

The auxiliary commode assembly of the present invention can be installed on any commode 10 that would fall in the category of standard (such as oval, elongated, or commercial) and is constructed to accommodate the differing heights and lengths of various commodes with the simple adjustment discussed above, i.e., the adjustments permitted by slot 18 and the slots (not shown) the braces 20 and 22 which are hidden by brace clamp 24.

FIG. 4 illustrates a front view of the device of the invention as adapted for use in a commercial setting. The only difference between this embodiment and that discussed above is that a connector or fitting 82 is connected to the water source. This fitting 82 provides water directly to the activating device 46 via a straight valve line 74'.

In a further alternative embodiment mentioned above, a second hydraulic cylinder assembly corresponding to that discussed above would be provided on the opposite side from cylinder 30. Such a double or twin cylinder embodiment is used with higher water pressure and/or where the lifting requirement is unknown, such as would be the case if the invention were to be used in a hospital setting wherein more than one person would have need of the invention.

It is noted that the present invention can be used at any location were a water source is available or can be made available, and in this regard, the water source can be a simple garden hose.

Although the present invention has been described relative to specific exemplary embodiments thereof, it will be understood by those skilled in the art that variations and modifications can be effected in these exemplary embodiments without departing from the scope and spirit of the invention.

What is claimed is:

1. A hydraulic commode assembly comprising a base support which, in use, fits around the base of a commode including a bowl, a first brace lug connected to said support on one side of the commode, a channel-shaped brace attached to said brace lug on one side of the commode and extending over the top of the commode rearwardly of the commode bowl, a second brace lug connected to said base support on the other side of the commode and to said channel-shaped brace, a cylinder lug attached to said base support approximately at the middle of the commode bowl, a seat for a user of the commode assembly, a hydraulic cylinder attached to said cylinder lug and including an extendable and retractable piston rod, first and second upright supports disposed, in use, one on each side of the commode and being secured to said base support near the front of the commode, said first and second upright supports each including first lower and second upper vertically spaced pivot connections, a support assembly for the seat including first and second laterally spaced, downwardly depending support members secured to each side of said seat, said first support member defining a pivot point toward the back of said seat, said second support member defining a laterally spaced pivot point toward the front of said seat, a first pair of pivotable link members including a pivotable dog leg link extending between, and pivotably connected to said first lower pivot connection of each said upright support and the pivot point of said first support member on each side of said commode, a second pivotable straight link extending between, and pivotably connected to, said second upper pivot connection of each said upright support and to said pivot point of second support member, on each side of said commode, at least one of said dog leg links being pivotably connected, intermediate the ends thereof, to said piston rod of said hydraulic cylinder-piston assembly, wherein with said piston rod in retracted position with respect to said cylinder said seat will assume a horizontal use position and with said piston rod in an extended position said seat will assume a tilted position near the front of said commode with the rear portion of said seat assuming a vertically higher position than the front of said seat, whereby in any position assumed by said seat said dog leg links and said straight links will cooperatively support said seat in such a manner that the paths of movement of said links never cross.

2. The assembly recited in claim 1 further comprising means for pivotably mounting said seat on said support assembly so as to enable the seat to be placed in a cleaning position.

3. The device recited in claim 1 wherein said channel-shaped brace comprises a pair of lower brace members, an upper channel-shaped brace member, and a brace clamp for adjustably connecting said upper brace member to said lower brace members so as to accommodate commodes of various heights.

4. The device recited in claim 1 wherein said brace lugs include mounting means for adjustably mounting said channel-shaped brace on said brace lugs so as to permit longitudinal movement of the channel-shaped brace relative to the base support.

5. The device recited in claim 1 further comprising a toe plate attached, in use, to the front of the base support in front of the bowl of the commode.

6. The device recited in claim 1 further comprising a water line, connected to a water connection for supplying water to the commode, for supplying pressure to said hydraulic cylinder.

7. The device recited in claim 1 further comprising control means for increasing and lowering the pressure in said hydraulic cylinder, a valve line means, attached, in use, to one end to a household water supply and at the other end to said control means, for providing water to pressurize said hydraulic cylinder, a cylinder hose attached at one end thereof to said control means and connected at the other end thereof to said hydraulic cylinder, and a discharge hose attached at one end thereof to said control means and connected at the other end thereof, in use, to the bowl of the commode for relieving the pressure in said hydraulic cylinder.

* * * * *